US007043793B2

(12) United States Patent
Lu

(10) Patent No.: US 7,043,793 B2
(45) Date of Patent: May 16, 2006

(54) ADJUSTABLE FRAME FOR HOLDING PAINT ROLLER

(76) Inventor: Weiming Lu, Mingye Painting Tools Products Co. Ltd., Beikeng Industrial Region of Longtang, Qingyuan City, Guangdong Province (CN)

( * ) Notice: Subject to any disclaimer, the term of this patent is extended or adjusted under 35 U.S.C. 154(b) by 89 days.

(21) Appl. No.: 10/806,861

(22) Filed: Mar. 22, 2004

(65) Prior Publication Data

US 2005/0091777 A1 May 5, 2005

(30) Foreign Application Priority Data

Nov. 3, 2003 (CN) ..... 2003 2 1176198 U

(51) Int. Cl.
*B05C 17/02* (2006.01)

(52) U.S. Cl. ..... 15/230.11; 492/13; 492/19

(58) Field of Classification Search ..... 15/144.1, 15/230.11; 492/13, 19
See application file for complete search history.

(56) References Cited

U.S. PATENT DOCUMENTS 2,702,917 A * 3/1955 Lynden ..... 15/230.11
2,866,995 A * 1/1959 Evensen ..... 15/230.11
5,000,671 A * 3/1991 Nolte ..... 425/231

FOREIGN PATENT DOCUMENTS

CN 2139030 Y 7/1993

* cited by examiner

*Primary Examiner*—Randall Chin
(74) *Attorney, Agent, or Firm*—Charles E. Baxley

(57) ABSTRACT

An adjustable frame for holding a paint roller includes a pair of square arms. Each of the pair of square arms includes a distal part, a joint part, a pair of shafts at the ends of the distal parts, and a pair of racks that are opposite to each other and are respectively fixed at the ends of the joint parts. A straight square tube holds the pair of joint parts and holds the pair of racks into its internal space. The pair of racks mesh with a gear wheel within the internal space of the square tube. A tee-joint holds the square tube. A pair of bearing holes through the walls of the tee-joint and the square tube hold up a bar, to which the gear wheel is fixed. One knob is fixed to one of two ends of the bar, outside the wall of the tee-joint. The present invention provides a holding-length adjustable frame that is capable of flexibly and tightly clamping and holding a variety of longitudinally sized paint rollers.

4 Claims, 3 Drawing Sheets

ADJUSTABLE FRAME FOR HOLDING PAINT ROLLER

BACKGROUND OF THE INVENTION

1. Field of the Invention

The present invention relates to frames for supporting rollers having cylindrical bodies and being able to roll, and particularly, the present invention relates to a frame for supporting a paint roller for coating a pigment or a paint on a wall surface of a building or furniture, etc.

2. Description of the Prior Art

Usually a frame for supporting a paint roller has a pair of arms with generally symmetrical bent shapes. Each of the arms has its distal part generally in parallel to the other and a shaft on the distal end to insert into the hole on one of the two ends of the paint roller to support it for rotation. Each of the arms also has its joint part fixed to or formed into a T-shape joint with a handle. The pair of joint parts form a fixed length, i.e., an unchangeable distance between the two ends of the pair of shafts, which means that the frame can clamp and hold only one longitudinally sized paint roller. That is to say that the prior art frame is not capable of fitting and holding a variety of longitudinally sized paint rollers, which results in an inconvenience in the operation of various paint rollers.

SUMMARY OF THE INVENTION

Having outlined the state of the prior art and its attendant shortages, the present invention's object is to provide an adjustable frame that is capable of adjusting the holding length of the frame to support and clip a wide variety of longitudinally sized paint rollers, moreover, the adjustment is flexible and the clipping force is strong.

The present invention provides an adjustable frame for holding a paint roller. The frame comprises a pair of square arms having uniform bent shapes and are configured symmetrically. Each of the square arms includes a distal part that is opposite to the other distal part, a joint part that is assembled opposite to, and in line with, the other joint part, a pair of shafts that are opposite to each other and are respectively fixed at the ends of the distal parts for inserting into the holes on the two ends of the paint roller, and a pair of racks that are opposite to each other and are respectively fixed at the ends of the joint parts. A square tube is straight, holds the pair of joint parts respectively through its two ends, and holds the pair of racks into its internal space accordingly. The pair of racks mesh with a gear wheel, across the gear wheel, within the internal space of the square tube. A tee-joint holds the square tube. Both the square tube and the tee-joint have a pair of bearing holes through their walls. The pair of bearing holes hold up a bar, to which the gear wheel is fixed. At least one knob is fixed to one of two ends of the bar, outside the wall of the tee-joint.

The adjustable frame for holding a paint roller of the present invention allows an operator to freely adjust the holding length formed by the joint parts of the square arms that are fitted into the square tube's internal space respectively through the square tube's two ends. By rotating the knob, through the bar and gear wheel, the racks move and consequently draw the distal parts away from, or close to, each other. The operator can change the holding length of the frame, i.e., the distance between the two ends of the pair of shafts and fit the pair of shafts tightly against any paint roller of different lengths. In other words, the present invention provides a holding-length adjustable frame that is capable of flexibly and tightly clamping and holding a variety of longitudinally sized paint rollers.

DETAILED DESCRIPTION OF THE PREFERRED EMBODIMENT

Figure 1:
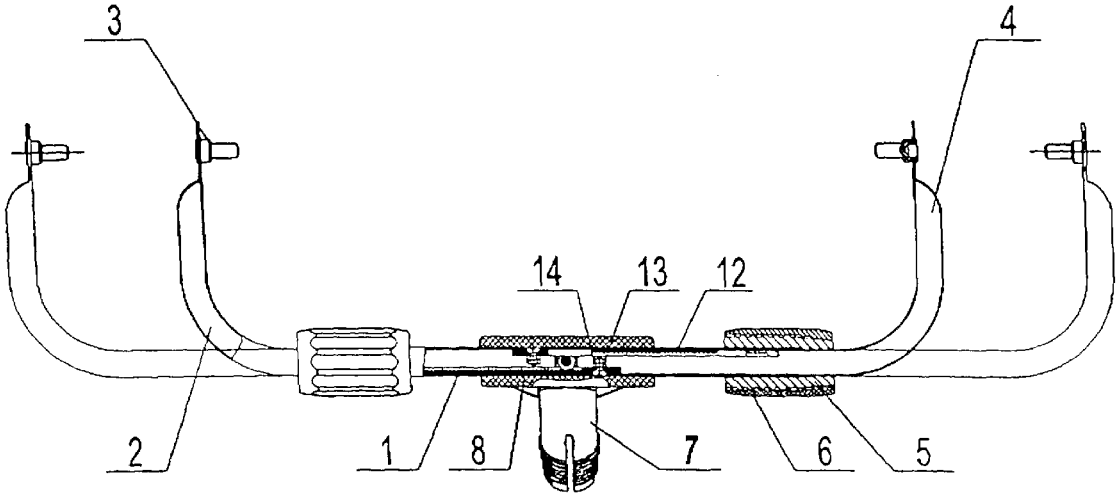
FIG. 1 is a schematic front view of an adjustable frame for holding a paint roller according to the present invention.
Figure 2:
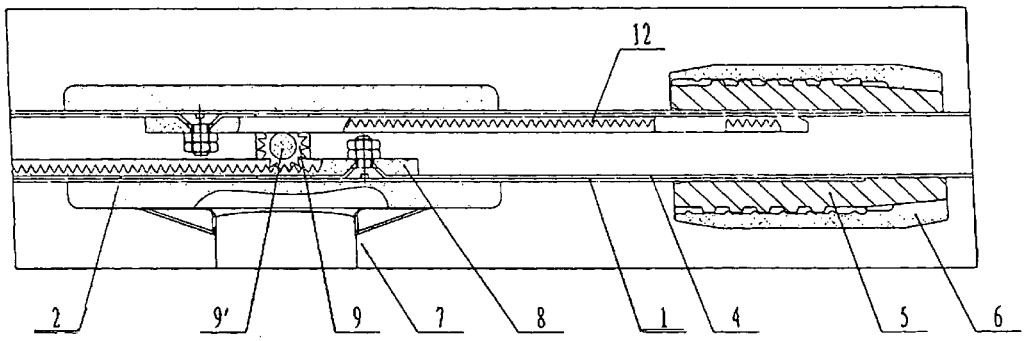
FIG. 2 is a sectional view of the adjustable frame including a tee-joint, a gear wheel, a pair of racks, joint parts and joint ends of a pair of square arms, a square tube, and one fastening set.
Figure 3:
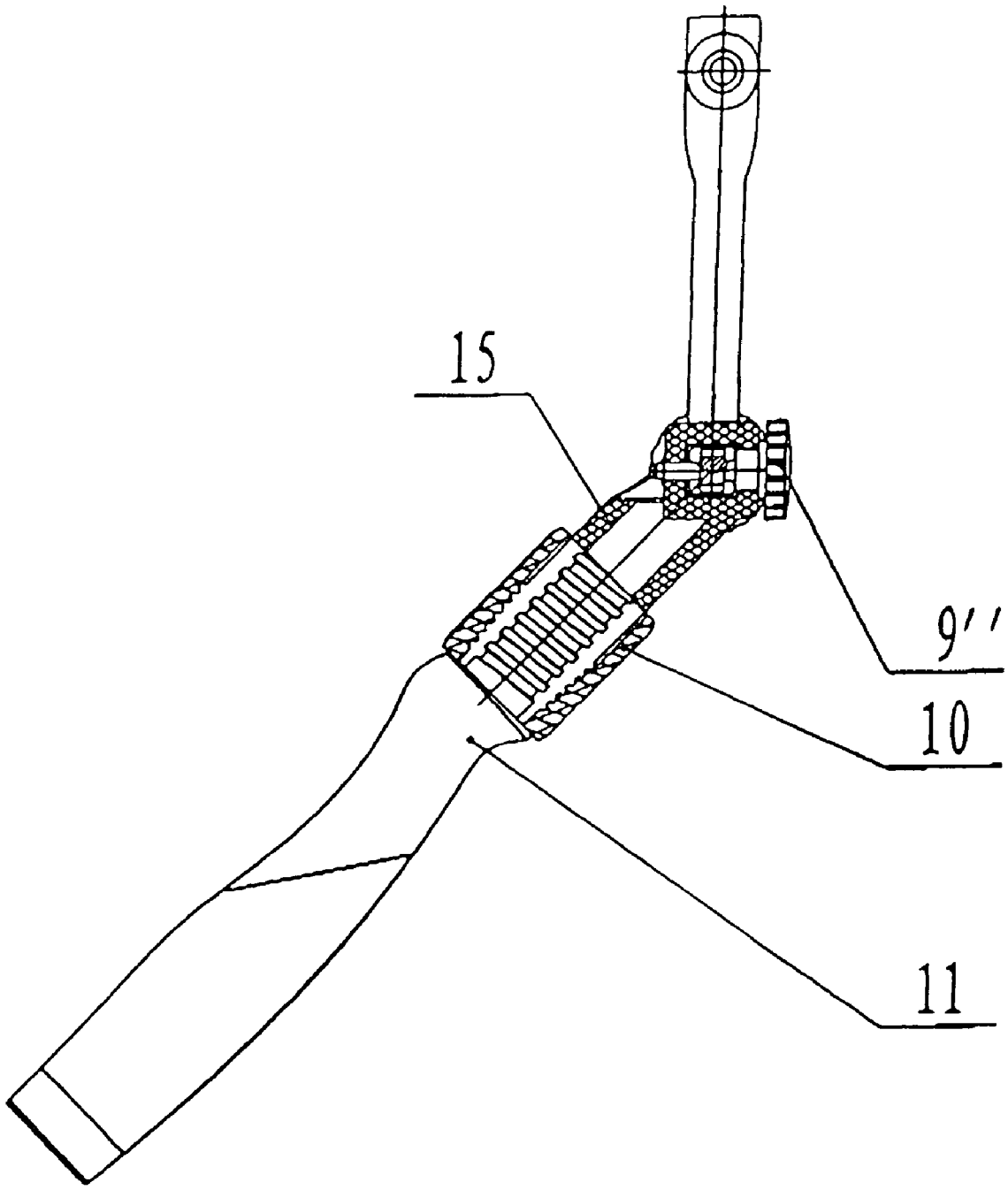
FIG. 3 is a partially sectioned side view of the adjustable frame with a handle.

As shown in FIGS. 1, 2, and 3, an adjustable frame for holding a paint roller comprises a pair of square arms 2 and 4 having uniform bent shapes. Each of the pair of square arms 2 and 4 includes a distal part that is in parallel to the other distal part, a joint part that is assembled opposite to, and in line with, the other joint part, a pair of shafts 3 that are opposite to, and in line with, each other and are respectively fixed at the ends of the distal parts for inserting into the holes on the two ends of the paint roller (not shown), and a pair of racks 8 and 12 that are opposite to each other and are respectively fixed at the ends of the joint parts. A square tube 1 is straight, holds the pair of square arms 2 and 4 respectively through its two ends, and holds the pair of racks 8 and 12 into its internal space accordingly. The pair of racks 8 and 12 mesh with a gear wheel 9, across the gear wheel 9, within the internal space of the square tube 1. A tee-joint 7 holds the square tube 1. Both the pair of square arms 2 and 4 and the tee-joint 7 have a pair of bearing holes through their walls. The pair of bearing holes hold up a bar 9', to which the gear wheel 9 is fixed. One knob 9" is fixed to one of two ends of the bar 9', outside the wall of tee-joint 7.

The racks 8 and 12 are fixed respectively at the ends of the joint parts with screw fasteners 13 and 14.

The adjustable frame also comprises a pair of fastening sets that are configured respectively at the two ends of the square tube 1. Each of the pair of fastening sets includes an inner pipe 5 having male threads on its outer wall and an outer pipe 6 having female threads on its cone-shaped inner wall. The inner pipe 5 holds both the square tube 1 and the joint part of an associated square arm 2 or 4. The outer pipe 6 fits the inner pipe 5 to enhance the holding force between the square tube 1 and the joint part of the associated square arm 2 or 4.

The tee-joint 7 includes a screw socket 15 having female threads on its inner wall to couple with a handle 11 and has male threads on its cone-shaped outer wall to couple with a screw tube 10 having female threads on its inner wall.

Before or after a coating operation, the operator may loosen the outer pipe 6 from the inner pipe 5 by rotating it, then rotate the knob 9" and consequently the gear wheel 9 moves the pair of racks 8 and 12 to bring the pair of ends of the pair of shafts 3 away from, or close to, each other in order to adjust the holding distance between the pair of shafts 3. By using the above adjustment, the operator can tightly fit a new paint roller having a different length from the replaced one on the frame, and then rotate the outer pipe 6 on the inner pipe 5 to tighten the inner pipe 5 for enhancing the coupling force between the joint parts of the pair of square arms 2 and 4 and the square tube 1. The operator may also fix a handle 11 into the screw socket 15 and further tighten it with the screw tube 10.

What is claimed is:

1. An adjustable frame for holding a paint roller, wherein the paint roller has two ends with holes, the frame comprising:

a) a pair of square arms having uniform bent shapes, wherein each of the square arms includes:

i) a distal part having an end and being opposite to the other distal part;

ii) a joint part having an end and being assembled opposite to, and in line with, the other joint part;

iii) a pair of shafts being opposite to each other and being respectively fixed at the ends of the distal parts for inserting into the holes on the two ends of the paint roller; and iv) a pair of racks being opposite to each other and being respectively fixed at the ends of the joint parts;

b) a bar having two ends;

c) a square tube being straight and having a wall, two ends, and an internal space, wherein the square tube holds the pair of joint parts respectively through its two ends and holds the pair of racks into its internal space accordingly, the pair of racks mesh with a gear wheel, across the gear wheel, within the internal space of the square tube;

d) a tee-joint holding the square tube and having a wall, wherein both the square tube and the tee-joint have a pair of bearing holes through their walls, the pair of bearing holes hold up the bar, to which the gear wheel is fixed; and e) at least one knob being fixed to one of the two ends of the bar, outside the wall of the tee-joint.

2. The adjustable frame of claim 1, wherein the pair of racks are fixed respectively at the ends of the joint parts with screw fasteners.

3. The adjustable frame of claim 1, wherein the adjustable frame further comprises a pair of fastening sets being configured respectively at the two ends of the square tube, wherein each of the pair of fastening sets includes an inner pipe having an outer wall with male threads thereon and an outer pipe having a cone-shaped inner wall with female threads thereon , the inner pipe holds both the square tube and the joint part of an associated square arm, the outer pipe fits the inner pipe to enhance the square tube's force for holding the joint parts.

4. The adjustable frame of claim 1, wherein the tee-joint includes a screw socket having an inner wall with female threads thereon to couple with a handle and having male threads on its cone-shaped-outer wall to couple with a screw tube having female threads on its inner wall.

* * * * *